United States Patent [19]

McCarten

[11] Patent Number: 4,944,820

[45] Date of Patent: Jul. 31, 1990

[54] METHOD FOR MAKING A BLANKET FOR AN EXTENDED NIP PRESS

[75] Inventor: Paul McCarten, Scranton, Pa.

[73] Assignee: Beloit Corporation, Beloit, Wis.

[21] Appl. No.: 179,086

[22] Filed: Apr. 8, 1988

[51] Int. Cl.[5] ..... B32B 31/00; B32B 31/22; D21F 3/00; B31C 13/00

[52] U.S. Cl. ..... 156/154; 156/193; 156/195; 427/179; 427/209; 427/289; 162/358

[58] Field of Search ..... 156/137, 140, 195, 193, 156/154; 474/271, 268; 162/358; 427/176, 179, 209, 289

[56] References Cited

U.S. PATENT DOCUMENTS

| | | | |
|---|---|---|---|
| 3,673,024 | 3/1969 | Eriksson | 156/195 |
| 3,964,328 | 6/1976 | Redmond Jr. | 156/140 |
| 3,998,986 | 12/1976 | Williamson | 156/148 |
| 4,123,946 | 11/1978 | Hollaway | 474/271 |
| 4,552,620 | 11/1985 | Adams | 162/358 |
| 4,643,916 | 2/1987 | Kiuchi | 427/210 |

*Primary Examiner*—Michael W. Ball
*Assistant Examiner*—Gregory J. Wilber
*Attorney, Agent, or Firm*—Dirk J. Veneman; Raymond W. Campbell; David J. Archer

[57] ABSTRACT

A blanket is disclosed for an extended nip press which includes a shoe and a felt. The blanket includes a band-shaped body which defines an inner and an outer surface. The inner surface is smooth for cooperation with the shoe such that the inner surface slides relative to the shoe. The outer surface cooperates with the felt and the body is fabricated from monocoque fiber-reinforced polyurethane instead of a laminate to inhibit delamination and creep of the body during use of the blanket.

10 Claims, 3 Drawing Sheets

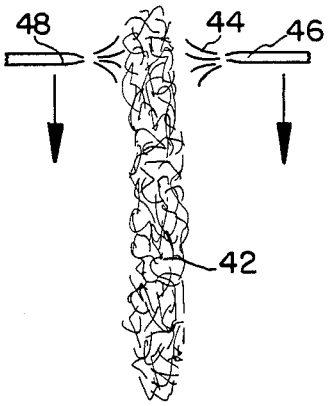
FIG. 3
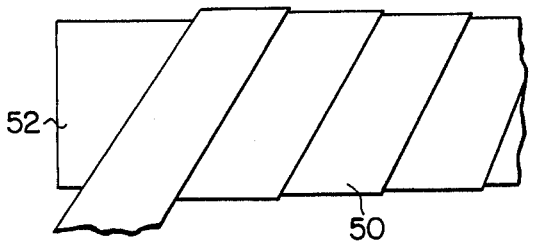
FIG. 4
FIG. 5
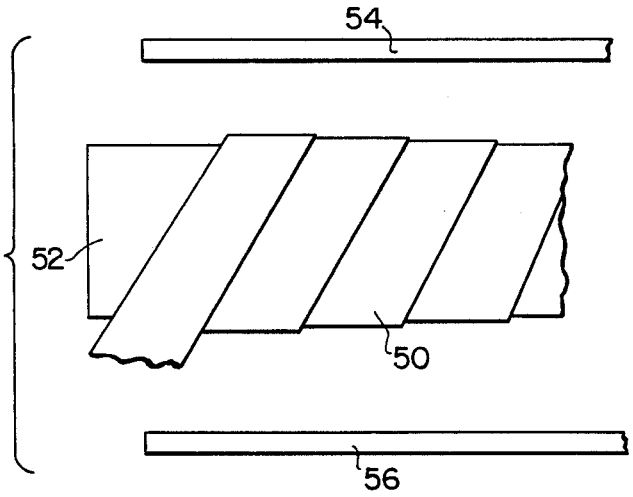
FIG. 6
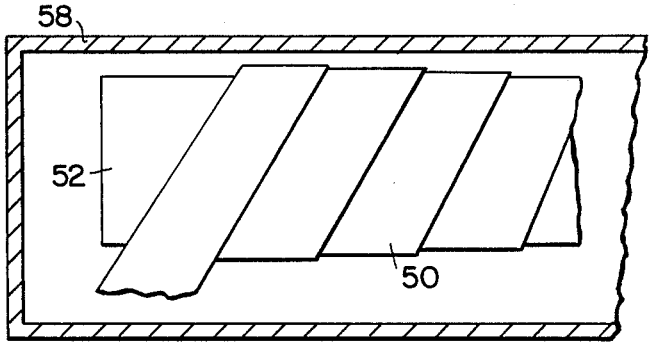

METHOD FOR MAKING A BLANKET FOR AN EXTENDED NIP PRESS

BACKGROUND OF THE INVENTION

1. FIELD OF THE INVENTION

This invention relates to a blanket for an extended nip press. More particularly, this invention relates to a vented blanket for an extended nip press which includes a shoe and a felt.

2. INFORMATION DISCLOSURE STATEMENT

With the introduction, by Beloit Corporation, of the so-called extended nip press, the art of papermaking has been revolutionized.

More specifically, an extended nip press includes a backing roll and a shoe defining a concave surface for cooperation with the backing roll. A band-shaped blanket (or belt) together with a felt and a paper web extend through an extended nip defined between the concave surface and the backing roll. By the provision of lubricant between the blanket and the concave surface, the residence time of the web within the nip is increased resulting in the removal of greater quantities of water from the web than is possible with a conventional nip defined by cooperating rolls.

In view of the very high pressures involved in extended nip presses (6000 psi), it is evident that the blanket is subjected to enormous compressional forces during passage through the extended nip. However, in order to facilitate drainage of increased quantities of water removed from the web to the felt during transit through the extended nip, it has been found advantageous to provide blind drilled holes or drainage channels (grooves) in the upper surface of the blanket. The arrangement is such that as the vented surface of the blanket comes into contact with the felt during passage through the extended nip, water flows from the felt into the blind drilled holes or grooves and away from the extended nip.

Preferably, in the case of grooves, the grooves are closely spaced relative to each other in order to provide maximum drainage from the extended nip. Furthermore, the grooves should have a width and depth sufficient to allow adequate flow of water therethrough. Unfortunately, the provision of closely-spaced grooves of sufficient depth and width weakens the structure of the blanket and this has resulted in collapsing or "barreling" of the grooves after prolonged usage of the prior art blankets.

In an attempt to overcome the aforementioned problems of barreling, or collapsing of the aforementioned blankets which has resulted in impairment of the drainage capabilities of these blankets, various proposals have been set forth in an attempt to provide a blanket having sufficient rigidity to inhibit closing of the grooves while maintaining sufficient flexibility of the blanket during transit through the extended nip.

U.S. Pat. No. 4,552,620 to Adams, assigned to Beloit Corporation, teaches an endless impervious belt for an extended nip having a woven fiber base impregnated with a urethane coating. The belt is formed by looping an endless scrim blanket around driving rollers providing a traveling run which is sprayed with a two-component polyurethane coating which quickly gels to accommodate building up of a layer of the desired thickness by controlling the fluid flow and speed of the traveling run. The resultant belt has a durometer hardness within the range 70–90 on the Shore A scale and column 4, lines 38–40 teach milling the surface 20 to form grooves 26 extending longitudinally around the belt.

U.S. Pat. No. 4,496,429 discloses an endless band which is impermeable to water. Column 2, lines 51–53 teach grooves for receiving water from the felt in the pressed surface of the V-bands or V-belts.

U.S. Pat. No. 4,482,430 to Majaniemi teaches a bearing blanket for an extended nip press in which a plurality of parallel spaced grooves 14 (shown in FIG. 6) are defined by the blanket and come into physical contact with a felt 8. However, as shown in FIGS. 4 and 6, the belt includes a woven base layer 15.

In the prior art, various proposals have been set forth which include the provision of a woven base fabric having applied thereto, respective coatings of polyurethane or the like. However, the resultant laminates have suffered from the problem of delamination after extensive use of the blanket. Because of the aforementioned, extremely high pressures involved in extended nip presses, there has existed a tendency for the laminated coatings to delaminate relative to the woven base.

The present invention seeks to overcome the aforementioned problem of delamination by providing a monocoque fiber-reinforced polyurethane blanket in which the reinforcing fibers are non-woven or partially oriented in the machine direction. The fibers therefore become randomly oriented throughout the thickness of the blanket structure.

Throughout the specification, the term "monocoque" means a composite, unitary construction wherein at least some of the fibers break through the surface of the blanket rather than the conventional blankets which include a plurality of laminates.

The arrangement is such that many of the randomly oriented fibers extend from within the blanket to the respective surfaces thereof, thereby imparting to the blanket increased strength, and an improved modulus of elasticity while avoiding the problem of delamination associated with fully woven base blankets.

Therefore, it is a primary object of the present invention to provide a blanket which overcomes the aforementioned problems associated with the prior art blankets and which contributes a significant improvement to the paper pressing art.

Another object of the present invention is the provision of a blanket which is fabricated from fiber-reinforced polyurethane for inhibiting delamination of the body during use of the blanket.

Another object of the present invention is the provision of a blanket for an extended nip press defining a plurality of water receiving blind drilled holes.

Another object of the present invention is the provision of a blanket for an extended nip press which is impervious to the flow of lubricant disposed between the shoe and the inner surface of the blanket body.

Another object of the present invention is the provision of a blanket for an extended nip press having a uniform thickness in the load zone and with grooves that are parallel and spaced relative to each other.

Another object of the present invention is the provision of a blanket body which is fabricated from a polyurethane having fibers randomly oriented therein.

Another object of the present invention is the provision of a blanket for an extended nip press in which the fibers impart reinforcement to the polyurethane such that the blanket body exhibits anisotropic properties.

Another object of the present invention is the provision of a blanket for an extended nip press in which the anisotropic properties of the body permit flexure of the band in a machine direction during passage through the extended nip press while inhibiting closing of the grooves by cross-machine direction flexure of the band thereby maintaining the drainage capabilities of the grooves.

Another object of the present invention is the provision of a method for fabricating a blanket for an extended nip press which includes saturating a fiber mat with polyurethane, wrapping the mat around a smooth mandrel, heating the wrapped mandrel so that the polyurethane gels, further heating the wrapped mandrel to cure the polyurethane, cooling the cured mat and grinding the same to a uniform thickness and then grooving the outer surface of the blanket while the blanket is still supported on the mandrel and thereafter removing the finished blanket from the mandrel.

Another object of the present invention is the provision of a method of fabricating a blanket for an extended nip press in which the fiber mat is non-woven.

Another object of the present invention is the provision of a method of fabricating a blanket for an extended nip press which includes spirally wrapping a saturated mat around a mandrel and overlapping the same such that the mat attains a thickness which is greater than the required thickness of the finished blanket.

Other objects and advantages of the present invention will be readily apparent to those skilled in the art by a consideration of the detailed description contained hereinafter and from the annexed drawings.

SUMMARY OF THE INVENTION

The present invention relates to a blanket and a method of fabrication thereof for an extended nip press which includes a shoe and a felt. The blanket includes a band-shaped body defining an inner and an outer surface. The inner surface is smooth for cooperation with the shoe such that the inner surface slides relative to the shoe. The outer surface cooperates with the felt for the reception therein of water removed from the felt during passage of the body and the felt through the extended nip press. The body is fabricated from monocoque fiber-reinforced polyurethane instead of a laminate for inhibiting delamination of the body during use of the blanket.

In a more specific embodiment of the present invention, the body encircles the shoe and defines a first edge and a second edge which is disposed parallel to the first edge. The inner surface is fluid impervious such that during use of the blanket a flow of lubricant disposed between the shoe and the inner surface through the body towards the outer surface is inhibited. The outer surface is machined such that the thickness of the body is uniform along the machine and cross-machine directions. The grooves are parallel and spaced relative to each other and extend in a machine-direction for facilitating flow of water removed from the felt during passage through the extended nip press.

In an alternative embodiment of the present invention, the grooves extend diagonally relative to the machine direction.

In another embodiment of the present invention, blind drilled holes are defined by the outer surface.

In all of the embodiments of the present invention, the body is fabricated from a polyurethane having fibers randomly oriented therein and the fibers impart reinforcement to the polyurethane such that the body exhibits anisotropic properties. More particularly, the anisotropic properties of the body permit flexure of the body in a machine direction during passage through the extended nip press while inhibiting closing of the grooves by cross-machine direction flexure of the body thereby maintaining the drainage capabilities of the grooves.

The method for fabricating a blanket according to the present invention includes saturating a fiber mat with polyurethane and wrapping the saturated mat around a smooth mandrel. The wrapped mandrel is heated such that the polyurethane gels. Then, the wrapped mandrel is further heated within a heating oven for curing the polyurethane. The cured mat, which constitutes the blanket, is then cooled and the blanket is ground to a uniform thickness. The outer surface of the blanket is grooved while the blanket is still supported on the mandrel and the finished blanket is then removed from the mandrel.

More particularly, the fiber mat is non-woven and is preferably fabricated from KEVLAR. Alternatively, the mat is fabricated from carbon fibers, graphite fibers, glass fibers, NOMEX or SPECTRA or blends of the aforementioned fibers. The wrapping step involves spirally wrapping the saturated mat around the mandrel such that the spirally-wound mat is overlapped during winding such that the mat attains a thickness which is greater than the required thickness of the finished blanket.

The heating of the wrapped mandrel is accomplished by rotating the wrapped mandrel in front of heating panels such that the polyurethane gels within a period within the range of 1–3 hours.

The step of curing the polyurethane is accomplished by maintaining a temperature of between 180–250° Fahrenheit for a period within the range of 12–60 hours.

Although, in the detailed description contained hereinafter, specific embodiments and method steps are disclosed, it will be evident to those skilled in the art that many variations and modifications may be made to the present invention without departing from the spirit and scope of the present invention which is defined by the appended claims.

More particularly, although it is preferable to wrap a saturated mat around a mandrel, it will be appreciate that the reinforcing fibers may be randomly oriented throughout the polyurethane such that individual fibers may be dispersed throughout the polyurethane rather than coating or spraying the polyurethane onto a non-woven mat.

Furthermore, another fabricating technique includes stretching a flexible metal belt between spaced parallel rollers and using the flexible metal belt in place of the rigid mandrel.

BRIEF DESCRIPTION OF THE DRAWINGS

FIG. 3 shows the step of saturating a non-woven mat with polyurethane.

FIG. 4 shows a mandrel being spirally wound with the mat shown in FIG. 3.

FIG. 5 shows the wrapped mandrel of FIG. 4 being heated so that the polyurethane gels.

FIG. 6 shows the wrapped mandrel within a heating oven for curing the blanket.

Similar reference characters refer to similar parts throughout the various embodiments of the present invention.

DETAILED DESCRIPTION OF THE DRAWINGS

Figure 1:
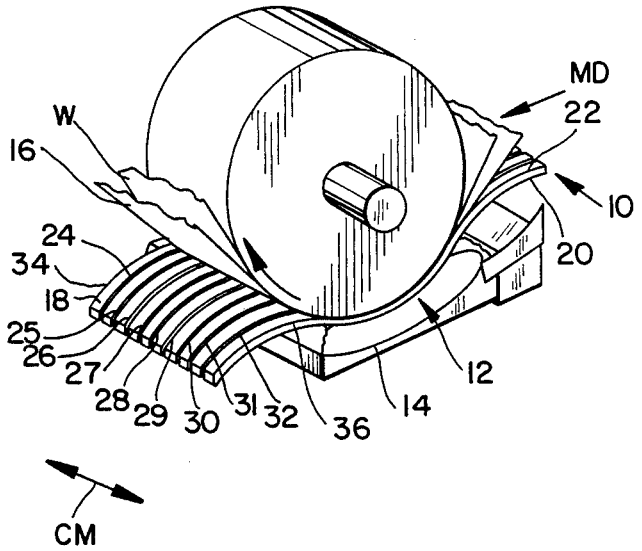
FIG. 1 is a perspective view of the blanket according to the present invention showing the disposition of the blanket relative to a shoe and backing roll.

FIG. 1 is a sectional of a blanket generally designated 10 for an extended nip press generally designated 12 which includes a shoe 14 and a felt 16. The blanket 10 includes a band-shaped body 18 defining an inner and an outer surface 20 and 22 respectively. The inner surface 20 is smooth for cooperation with the shoe 14 such that the inner surface 20 slides relative to the shoe 14. The outer surface 22 cooperates with the felt 16. The outer surface 22 defines a plurality of grooves 24,25,26,27,28,29,30,31 and 32 for the reception therein of water removed from the felt 16 during passage of the body 18 and the felt 16 together with a web W through the extended nip press 12. The body 18 is fabricated from fiber-reinforced polyurethane for inhibiting delamination of the body 18 during use of the blanket 10.

As shown in FIG. 1, the body 18 encircles the shoe 14 and defines a first edge 34 and a second edge 36 disposed parallel to the first edge 34.

The inner surface 20 of the body 18 is fluid impervious such that during use of the blanket 10 a flow of lubricant disposed between the shoe 14 and the inner surface 20 through the body 18 towards the outer surface 22 is inhibited.

The outer surface 22 is machined such that the thickness of the body 18 is uniform along the machine and cross-machine directions MD and CM thereof.

The grooves 24 to 32, as shown in FIG. 1, are parallel and spaced relative to each other and extend in the machine direction MD for facilitating flow of water removed from the felt 16 during passage through the extended nip press 12.

Figure 2:
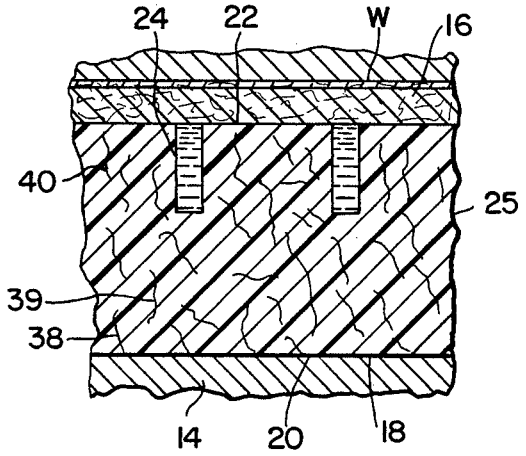
FIG. 2 is a sectional view of the blanket according to the present invention.

Preferably the body 18 is fabricated from a polyurethane having fibers 38,39 and 40 randomly oriented therein as shown in FIG. 2. The fibers 38–40 impart reinforcement to the polyurethane such that the body 18 exhibits anisotropic properties and, more particularly, these anisotropic properties permit flexure of the body 18 in the machine direction MD during passage through the extended nip press 12 while inhibiting closing of the grooves 24 to 32 by cross-machine direction flexure of the body 18 thereby maintaining the drainage capabilities of the grooves 24 to 32.

FIGS. 3–6 show a method of fabricating a blanket 10 for an extended nip press 12 which includes a shoe 14 and a felt 16 and includes the steps of saturating a fiber mat 42 with polyurethane 44 sprayed from nozzles 46 and 48 as shown in FIG. 3.

FIG. 4 shows the saturated mat 50 being wrapped around a smooth mandrel 52, the mat 50 being spirally wound and overlapped such that the saturated mat attains a thickness greater than the required thickness of the finished blanket.

FIG. 5 shows the wrapped mandrel 52 being heated by heating panels 54 and 56 such that the polyurethane gels.

Figure 7:
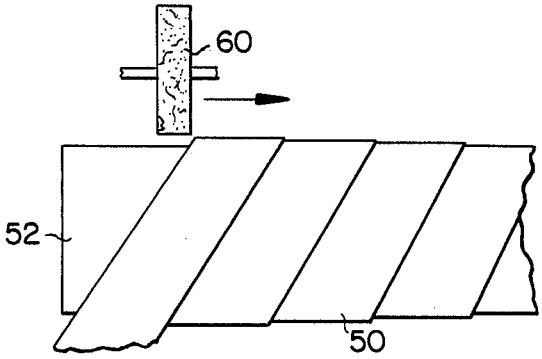
FIG. 7 shows the cured blanket having been cooled and still on the mandrel and being ground.
Figure 8:
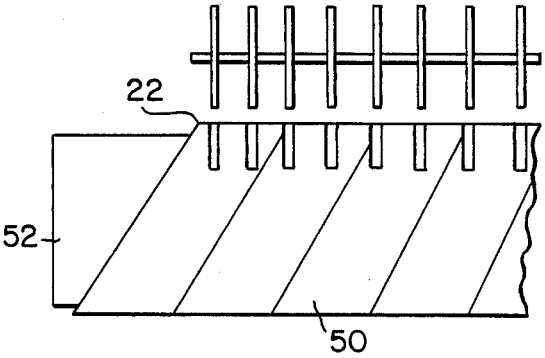
FIG. 8 shows the grooved blanket of FIG. 7 being grooved.

FIG. 6 shows further heating of the wrapped mandrel 52 within an oven 58 in order to cure the polyurethane. Thereafter, the cured mat 50 is cooled and is ground by grinding roll 60 as shown in FIG. 7 while the blanket 50 is still on the mandrel 52 such that the blanket 50 attains a uniform thickness. The outer surface 22 of the blanket 50 is then grooved as shown in FIG. 8 while the blanket is still supported on the mandrel 52. Such grooving is accomplished by bringing a plurality of rotating discs 62 into contact with the outer surface 22 as shown in FIG. 8. Finally, the finished blanket is removed from the mandrel 52.

Figure 9:
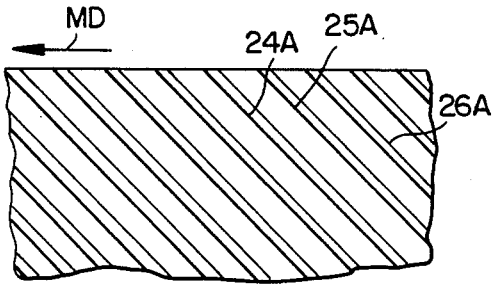
FIG. 9 shows an alternative embodiment of the present invention in which the grooves are diagonal relative to the machine-direction.

FIG. 9 shows an alternative grooving configuration of the outer surface of the blanket such that the grooves 24A, 25A and 26A are disposed diagonally relative to the cross-machine direction MD.

Figure 10:
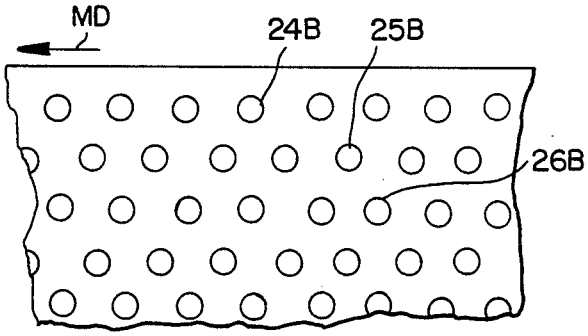
FIG. 10 shows an alternative embodiment of the present invention in which the outer surface is blind drilled.

FIG. 10 shows the blanket having a plurality of blind drilled holes 24B,25B and 26B drilled therein for the reception of water pressed from the web.

Preferably, the fiber mat 42- is non-woven and is fabricated from KEVLAR. Alternatively, glass fibers, graphite fibers or carbon fibers or the like could be used and the mat could be partially woven such that the fibers are oriented more into the machine direction than the cross-machine direction.

The curing of the polyurethane is carried out, as shown in FIG. 6, at a temperature within the range 180–250° Fahrenheit and preferably at approximately 212° Fahrenheit for a period within the range of 12–60 hours.

The resultant blanket exhibits improved resistance to groove collapse and, therefore, provides a durable extended nip press blanket which is resistant to delamination and which provides excellent drainage from an extended nip.

What is claimed is:

1. A method of fabricating a blanket for an extended nip press which includes a shoe and a felt, said method including the sequential steps of:

simultaneously saturating a fiber mat on both sides thereof with polyurethane;

wrapping the saturated mat around a smooth mandrel;

heating the wrapped mandrel such that the polyurethane gels;

further heating the wrapped mandrel within a heating over for curing the polyurethane;

cooling the cured mat which constitutes the blanket;

grinding the blanket to a uniform thickness;

grooving the outer surface of the blanket while the blanket is still supported on the mandrel; and removing the finished blanket from the mandrel.

2. A method as set forth in claim 1 wherein the fiber mat is non-woven.

3. A method as set forth in claim 2 wherein the fiber mat is fabricated from KEVLAR.

4. A method as set forth in claim 1 wherein the saturated mat is spirally wrapped around the mandrel.

5. A method as set forth in claim 4 wherein the spirally-wound mat is overlapped during winding such that the mat attains a thickness which is greater than the required thickness of the finished blanket.

6. A method as set forth in claim 1 wherein the step of heating the saturated mat includes:

rotating the wrapped mandrel in front of heating panels such that the polyurethane gels.

7. A method as set forth in claim 6 wherein the time taken for heating the wrapped mandrel is within the range of 1–3 hours.

8. A method as set forth in claim 1 wherein the step of further heating the wrapped mandrel is carried out at a temperature within the range of 180–250° Fahrenheit.

9. A method as set forth in claim 8 wherein the temperature is preferably approximately 212° Fahrenheit.

10. A method as set forth in claim 8 wherein the polyurethane is cured within a period of between 12–60 hours.

* * * * *

UNITED STATES PATENT AND TRADEMARK OFFICE

CERTIFICATE OF CORRECTION

PATENT NO. : 4,944,820

DATED : July 31, 1990

INVENTOR(S) : Paul McCarten

It is certified that error appears in the above—identified patent and that said Letters Patent is hereby corrected as shown below:

Column 6, Line 25: Delete "-" after "42".

Column 6, Line 53: Delete "over" and insert therefor --oven--.

Signed and Sealed this

Twenty-seventh Day of August, 1991

*Attest:*

HARRY F. MANBECK, JR.

*Attesting Officer*

*Commissioner of Patents and Trademarks*